US008346117B2

(12) United States Patent
Ishii et al.

(10) Patent No.: US 8,346,117 B2
(45) Date of Patent: Jan. 1, 2013

(54) FIXING DEVICE AND IMAGE FORMING APPARATUS USING SAME

(75) Inventors: Kenji Ishii, Kawasaki (JP); Tadashi Ogawa, Machida (JP); Satoshi Ueno, Komae (JP); Hiroshi Seo, Sagamihara (JP); Masanao Ehara, Zama (JP)

(73) Assignee: Ricoh Company, Limited, Tokyo (JP)

( * ) Notice: Subject to any disclaimer, the term of this patent is extended or adjusted under 35 U.S.C. 154(b) by 302 days.

(21) Appl. No.: 12/923,032

(22) Filed: Aug. 30, 2010

(65) Prior Publication Data

US 2011/0064450 A1 Mar. 17, 2011

(30) Foreign Application Priority Data

Sep. 14, 2009 (JP) ..... 2009-211522
Apr. 27, 2010 (JP) ..... 2010-101562

(51) Int. Cl.
*G03G 21/00* (2006.01)

(52) U.S. Cl. ..... 399/98; 399/122

(58) Field of Classification Search ..... 399/91, 399/98, 99, 101, 107, 120, 320, 328, 329; 219/216, 619

See application file for complete search history.

(56) References Cited

U.S. PATENT DOCUMENTS

| | | | |
|---|---|---|---|
| 5,400,123 | A | 3/1995 | Sato et al. |
| 5,753,399 | A | 5/1998 | Hayase et al. |
| 5,832,354 | A | 11/1998 | Kouno et al. |
| 5,915,147 | A | 6/1999 | Kouno et al. |
| 6,002,903 | A | 12/1999 | Hayase et al. |
| 6,219,520 | B1 | 4/2001 | Ehara |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,785,505 | B2 | 8/2004 | Yasui et al. |
| 6,807,386 | B2 | 10/2004 | Yasui et al. |
| 6,813,464 | B2 | 11/2004 | Amita et al. |
| 6,881,927 | B2 | 4/2005 | Yoshinaga et al. |
| 6,892,044 | B2 | 5/2005 | Yasui et al. |
| 6,937,827 | B2 | 8/2005 | Katoh et al. |
| 7,022,944 | B2 | 4/2006 | Yoshinaga et al. |
| 7,266,336 | B2 | 9/2007 | Ueno et al. |

(Continued)

FOREIGN PATENT DOCUMENTS

JP 61193169 A 8/1986

(Continued)

OTHER PUBLICATIONS

English language abstract of JP-09034163 published Feb. 7, 1997 (which corresponds to JP-3227381-B2).

*Primary Examiner* — Hoan Tran

(74) *Attorney, Agent, or Firm* — Harness, Dickey & Pierce, P.L.C.

(57) ABSTRACT

A fixing device includes a heating source; a heating member heated by the heating source; a pressing member contacting the heating member to form a fixing nip therebetween, at which an unfixed image of toner on a recording sheet is fixed to the recording sheet; a first charging member located at an entrance of the fixing device, from which the recording sheet bearing the unfixed toner image enters the fixing device, so as to face the unfixed toner image. The first charging member is not contacted with the heating member and pressing member, and has a charge with a polarity opposite to a polarity of a charge of the toner to collect floating particles of the toner.

6 Claims, 5 Drawing Sheets

U.S. PATENT DOCUMENTS

| | | | | |
|---|---|---|---|---|
| 7,359,666 | B2 * | 4/2008 | Takashi et al. | 399/329 |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,693,439 | B2 | 4/2010 | Seo et al. | |
| 7,715,774 | B2 | 5/2010 | Ueno | |
| 7,769,311 | B2 * | 8/2010 | Tsubaki | 399/67 |
| 2006/0029411 | A1 | 2/2006 | Ishii et al. | |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0059003 | A1 | 3/2007 | Shinshi et al. | |
| 2007/0059011 | A1 | 3/2007 | Seo et al. | |
| 2007/0212089 | A1 | 9/2007 | Seo et al. | |
| 2007/0242988 | A1 | 10/2007 | Seo et al. | |
| 2007/0280754 | A1 | 12/2007 | Ogawa et al. | |
| 2008/0025772 | A1 | 1/2008 | Seo et al. | |
| 2008/0025773 | A1 | 1/2008 | Ito et al. | |
| 2008/0063443 | A1 | 3/2008 | Yoshinaga et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2008/0317532 | A1 | 12/2008 | Ehara et al. | |
| 2009/0060550 | A1 | 3/2009 | Seo | |

FOREIGN PATENT DOCUMENTS

| | | | |
|---|---|---|---|
| JP | 04291285 | A | 10/1992 |
| JP | 3227381 | B2 | 2/1997 |
| JP | 09094999 | A | 4/1997 |
| JP | 09212029 | A | 8/1997 |

* cited by examiner

FIXING DEVICE AND IMAGE FORMING APPARATUS USING SAME

BACKGROUND OF THE INVENTION

1. Field of the Invention

The present invention relates to a fixing device for fixing a toner image to a receiving material upon application of heat and pressure thereto, and to an image forming apparatus, such as an electrophotographic copier, printer, facsimile machine or the like, having the fixing device.

2. Discussion of the Related Art

Conventionally, electrophotographic image forming apparatuses, such as electrophotographic copiers, printers and facsimile machines, having a fixing device in which a toner image formed on a recording sheet is fixed thereto upon application of heat and pressure, are known.

Such a fixing device tends to induce toner scattering, such that when a recording sheet bearing an unfixed toner image thereon enters a fixing nip of the fixing device, toner particles constituting the unfixed toner image are electrostatically scattered and scattered due to uncontrolled movement (swinging or the like) of the recording sheet. Particularly when a recording sheet bearing an unfixed toner image thereon is vertically fed to a fixing device, toner particles constituting the unfixed toner image often scatter at the entrance of the fixing device, thereby contaminating neighboring components such as a heating roller and/or a pressing roller of the fixing device, resulting in formation of an abnormal image with the background and/or backside soiled with toner transferred from the rollers. Jamming of a recording sheet in the fixing device because the sheet is adhered to the contaminated roller often results as well.

The abnormal image problem will be described in detail.

Specifically, electrophotographic image forming apparatuses typically perform an image forming operation such that after a toner image formed on a photoreceptor is transferred onto a recording sheet, the toner image is fixed thereto by a fixing device.

The fixing device typically has a heating roller having a heater therein or an induction heater arranged outside, and a pressing roller rotating contacting the heating roller to form a fixing nip so that when a recording sheet bearing an unfixed toner image thereon passes through the fixing nip, the toner image is fixed to the recording sheet.

In this regard, the unfixed toner image is contacted with the circumferential surface of the heating roller. Even when the circumferential surface of the heating roller has good releasability initially, foreign materials such as toner particles (such as small toner particles and toner particles finely pulverized in a developing device) and paper dust adhere thereto after long repeated use. In attempting to prevent adhesion of such foreign materials, a cleaner such as cleaning rollers, cleaning blades, and cleaning pads is typically contacted with the circumferential surface of the heating roller. However, even in this case, foreign materials such as toner particles adhere to the cleaner, thereby degrading the cleanability of the cleaner. Therefore, the cleaner has to be frequently replaced with a new cleaner, thereby complicating maintenance, and increasing running costs.

In addition, toner particles scattering at the entrance of the fixing device can easily adhere to the pressing roller, and the toner particles adhered to the heating roller are transferred onto the pressing roller. Therefore, the pressing roller is also typically made of a material having good releasability.

In attempting to solve the toner scattering problem, a technique such that a voltage having a polarity opposite to that of the toner (developer) used is applied to a cleaning roller contacted with a heating roller is proposed. However, the technique has several drawbacks. For one, the cleaning roller serving as a biasing roller is always contacted with the heat roller, the surface of the heating roller is damaged, and the heating roller is contaminated worse than in a case in which the cleaning roller is not provided because foreign materials adhered to the surface of the cleaning roller rub the surface of the heating roller. Moreover, foreign materials other than charged toner particles cannot be removed from the surface of the heating roller by the cleaning roller, necessitating provision of another cleaner to clean the surface of the cleaning roller.

In addition, an unfixed toner image on a recording sheet is fed to the entrance of a fixing device in an unstable state, insofar as the toner is adhered only electrostatically to the sheet. In addition, with recent miniaturization of electrophotographic image forming apparatuses, a recording sheet bearing an unfixed toner image thereon is typically fed vertically to a fixing device, making the toner image even less stable. When a recording sheet bearing the toner image is swung in a sheet feeding passage leading to the fixing device, or strongly strikes the entrance of the fixing device, or the electric potential of the toner image changes because of being contacted with a guide member guiding the sheet to the fixing device, the toner image on the sheet may be mechanically or electrostatically scattered, thereby contaminating various parts of the fixing device and image forming apparatus, with the undesirable results described previously.

For these reasons, there is a need for a fixing device which hardly forms abnormal images caused by the above-mentioned mechanical and electrostatic toner scattering problems.

SUMMARY

This patent specification describes a novel fixing device for fixing an unfixed toner image formed on a recording sheet, one embodiment of which includes a heat source, a heating member heated by the hearing source, a pressing member contacting the heating member to form a fixing nip therebetween at which the unfixed toner image is fixed to the recording sheet, and a charging member located at the entrance of the fixing device so as to face the unfixed toner image on the recording sheet. The charging member is not contacted with the heating member and the pressing member, and has a charge with a polarity opposite to that of a charge of the toner.

The fixing device may have a second charging member, which is rotated while contacted with the first charging member to frictionally charge the first-mentioned charging member to impart the charge to the first-mentioned charging member.

This patent specification further describes a novel image forming apparatus, one embodiment of which includes an image forming device configured to form an unfixed toner image on a recording sheet, and the above-mentioned fixing device configured to fix the unfixed toner image to the recording sheet.

BRIEF DESCRIPTION OF THE DRAWINGS

A more complete appreciation of aspects of the invention and many of the attendant advantage thereof will be readily obtained as the same become better understood by reference to the following detailed description when considered in connection with the accompanying drawings, wherein.

DESCRIPTION OF THE PREFERRED EMBODIMENTS

Figure 1:
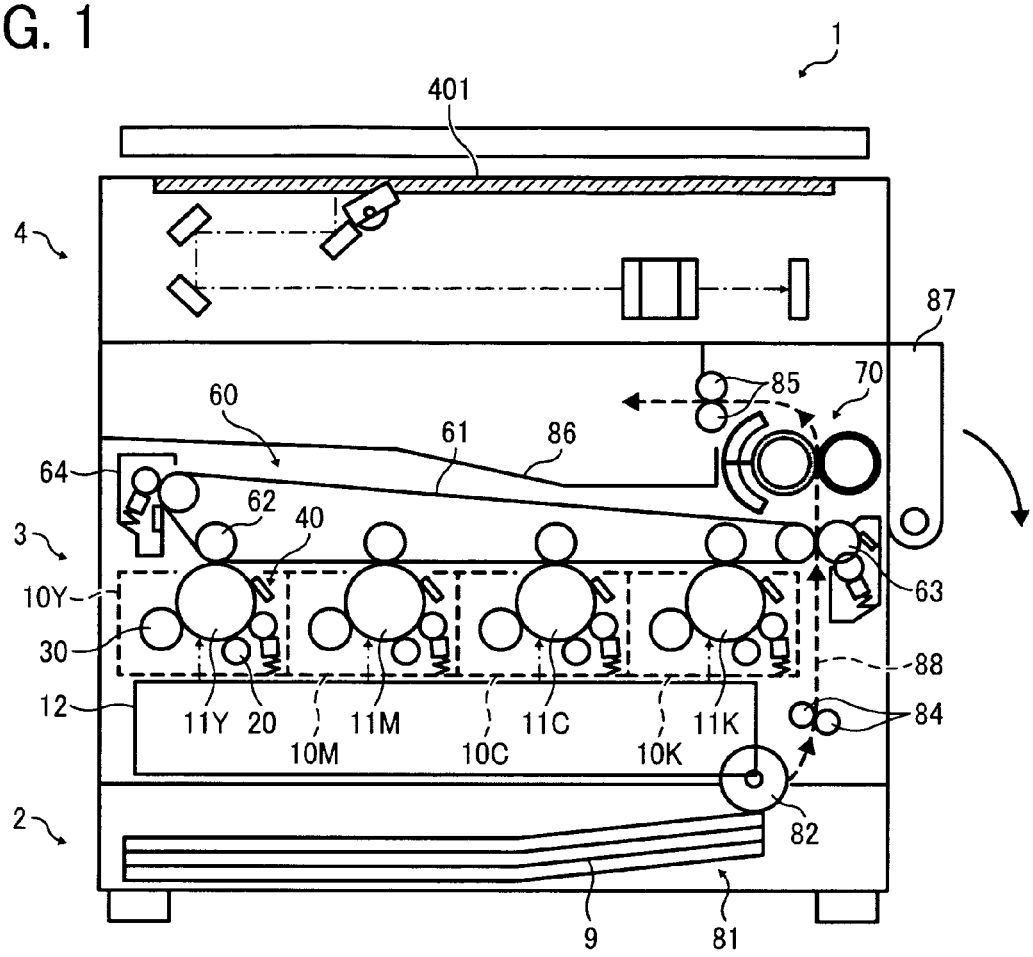
FIG. 1 is a schematic view illustrating a color image forming apparatus as one example of the image forming apparatus of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element (s) or feature (s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, example embodiments of the present patent application are described.

FIG. 1 is a schematic view illustrating a color image forming apparatus as one example of an image forming apparatus of the present invention.

Referring to FIG. 1, an electrophotographic color image forming apparatus 1 includes a scanner 4 located above a main body of the image forming apparatus and reading the image of an original document set on a glass table 401, a sheet feeding device 2 configured to feed a recording sheet 9, and an image forming section 3 configured to form a toner image on the recording sheet fed from the sheet feeding device. The image forming apparatus 1 further includes a manual sheet tray 87, which pivots in a direction indicated by an arrow so that one or more recording sheets are set to be fed to the image forming section 3, and a duplex unit (not shown) configured to reverse a recording sheet to perform duplex printing.

The image forming section 3 includes a transferring device 60 including an endless intermediate transfer belt 61. The transferring device 60 has plural rollers tightly stretching the intermediate transfer belt 61 so as to extend it horizontally while rotating the belt counterclockwise in FIG. 1.

Process cartridges 10Y, 10M, 10C and 10K serving as image forming units forming yellow (Y), magenta (M), cyan (C) and black (K) toner images are arranged below the transferring device 60 so as to extend in a tandem manner along the intermediate transfer belt 61. By combining yellow, magenta, cyan and black toner images, a full color image can be formed.

Each of the image forming units 10 includes a photoreceptor 11 (11Y, 11M, 11C or 11K), and a charging device 20 configured to charge the photoreceptor, a developing device 30 configured to develop an electrostatic latent image on the photoreceptor, and a cleaning device 40 configured to clean the surface of the photoreceptor, arranged around the photoreceptor. In addition, a light irradiating device 12 is provided below the image forming unit 10 to irradiate the charged photoreceptor with a light beam to form an electrostatic latent image on the photoreceptor 11.

The sheet feeding device 2 arranged below the light irradiating device 12 includes a sheet cassette 81 configured to contain a stack of recording sheets 9, and a feeding roller 82 configured to feed the recording sheets 9 one by one to a sheet feeding passage 88. Although this image forming apparatus has only one sheet cassette, the number of cassettes is not limited thereto.

The sheet feeding passage 88, which is simply a passageway defined by adjacent components of the image forming apparatus 1, extends vertically from a lower portion to an upper portion on the right side of the main body of the apparatus 1. In addition, a copy tray 86 serving as a sheet discharging portion is formed in a space between the main body and the scanner 2. The image forming apparatus 1 can have an optional sheet discharging portion having multiple bins and a sorting function, which is not shown in FIG. 1.

A pair of registration rollers 84, a secondary transfer roller 63 opposed to the intermediate transfer belt 61, a fixing device 70, and a pair of discharging rollers 85 are provided along the sheet feeding passage 88.

A feeder (not shown) is arranged below the secondary transfer roller 63 to feed the recording sheet 9 fed from a duplex unit (not shown) to the pair of registration rollers 84 and to feed a recording sheet set on the manual sheet tray 87.

When an original image is copied, at first the original image is read by the scanner 2. The light irradiating device 12 irradiates the photoreceptors 11, which are previously charged by respective charging devices 20, with light beams according to Y, M, C and K image information to form electrostatic latent images on the photoreceptors. The developing devices 30 develop the electrostatic latent images on the respective photoreceptors 11 with Y, M, C and K developers to form Y, M, C and K toner images on the respective photoreceptors. The thus-formed Y, M, C and K toner images are sequentially transferred onto proper positions of the surface of the intermediate transfer belt 61 by primary transfer rollers 62 to form a combination color toner image consisting of Y, M, C and K toner images on the surface of the intermediate transfer belt. In this regard, residual toners remaining on the surfaces of the photoreceptors 11 without being transferred are removed therefrom by respective cleaning devices 40 so that the photoreceptors can be ready for the next image forming operation.

On the other hand, the feeding roller 82 is rotated to feed an uppermost sheet of the stack of recording sheets 9 in the sheet cassette 81 to the pair of registration rollers 84 through the sheet feeding passage 88. After the thus-fed recording sheet is stopped once by the registration rollers 84, the recording sheet is timely fed to a secondary transfer nip formed by the intermediate transfer belt 61 and the secondary transfer roller 63 so that the combined color toner image on the intermediate transfer belt is transferred onto the recording sheet 9. After the secondary transfer operation, the surface of the intermediate transfer belt 61 is cleaned by a cleaner 64.

The recording sheet 9 bearing the combined color toner image thereon is then fed to the fixing device 70 so that the combined color toner image is fixed to the recording sheet, resulting in formation of a full color image (i.e., a full color copy). The recording sheet 9 is then fed to the copy tray 86. By repeating the image forming operation, copies are stacked on the copy tray 86.

In this image forming apparatus, the image forming units 10, light irradiating device 12, transferring device 60, registration rollers 84, etc., serve as an image forming device configured to form an unfixed toner image on a recording sheet.

Figure 2:
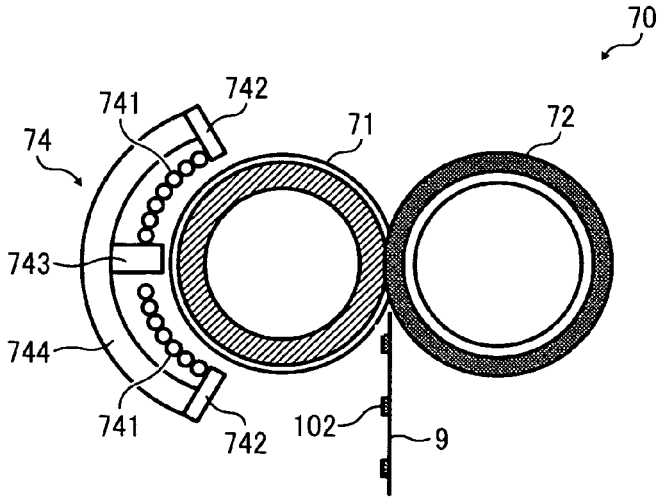
FIG. 2 is a schematic view illustrating a roller fixing device for use in the image forming apparatus of the present invention.

FIG. 2 is a schematic view illustrating a roller fixing device for use in the image forming apparatus of the present invention.

Referring to FIG. 2, it can be seen that, in this particular embodiment, the fixing device 70 includes an induction heater 74 serving as a heat source, a heating roller 71 serving as a heating member, and a pressing roller 72 serving as a pressing member. Reference numeral 102 denotes an unfixed toner image on the recording sheet 9. The induction heater 74 serving as a magnetic flux generator drives a coil pile 741 to generate radio-frequency waves, resulting in generation of an eddy current in the heating roller 71, which is typically made of metal, thereby increasing the temperature of the surface of the heating roller. Namely, the outermost layer of the heating roller 71 is a heating layer, which heats by means of the thus-generated magnetic fluxes.

The induction heater 74 includes leg cores 742, a center core 743 and an arch core 744. The coil pile 741 is located between the arch core 744 and the heating roller 71.

Since the amount of magnetic fluxes generated by the induction heater 74 is proportional to the number of wires of the wound coil, a pile of wires having a cover layer thereon is used as the coil pile 741 to increase the amount of magnetic fluxes. The coil pile 741 extends in the longitudinal direction thereof so as to face the heating roller 71 so that eddy current is generated on the entire surface of the heating roller 71. It is preferable to set the coil pile 741 so as to be closer to the surface of the heating roller 71 to enhance the heat rising effect of the heating roller.

In this example, a roller (such as the heating roller 71) is used as the heating member. Alternatively, however, sheets (such as fixing films and fixing belts) can also be used as the heating member. In addition, heating methods using heat radiation or contact heating using a heat source such as halogen heaters and electric heaters can also be used as the heating method instead of the above-mentioned induction heating method.

Figure 3:
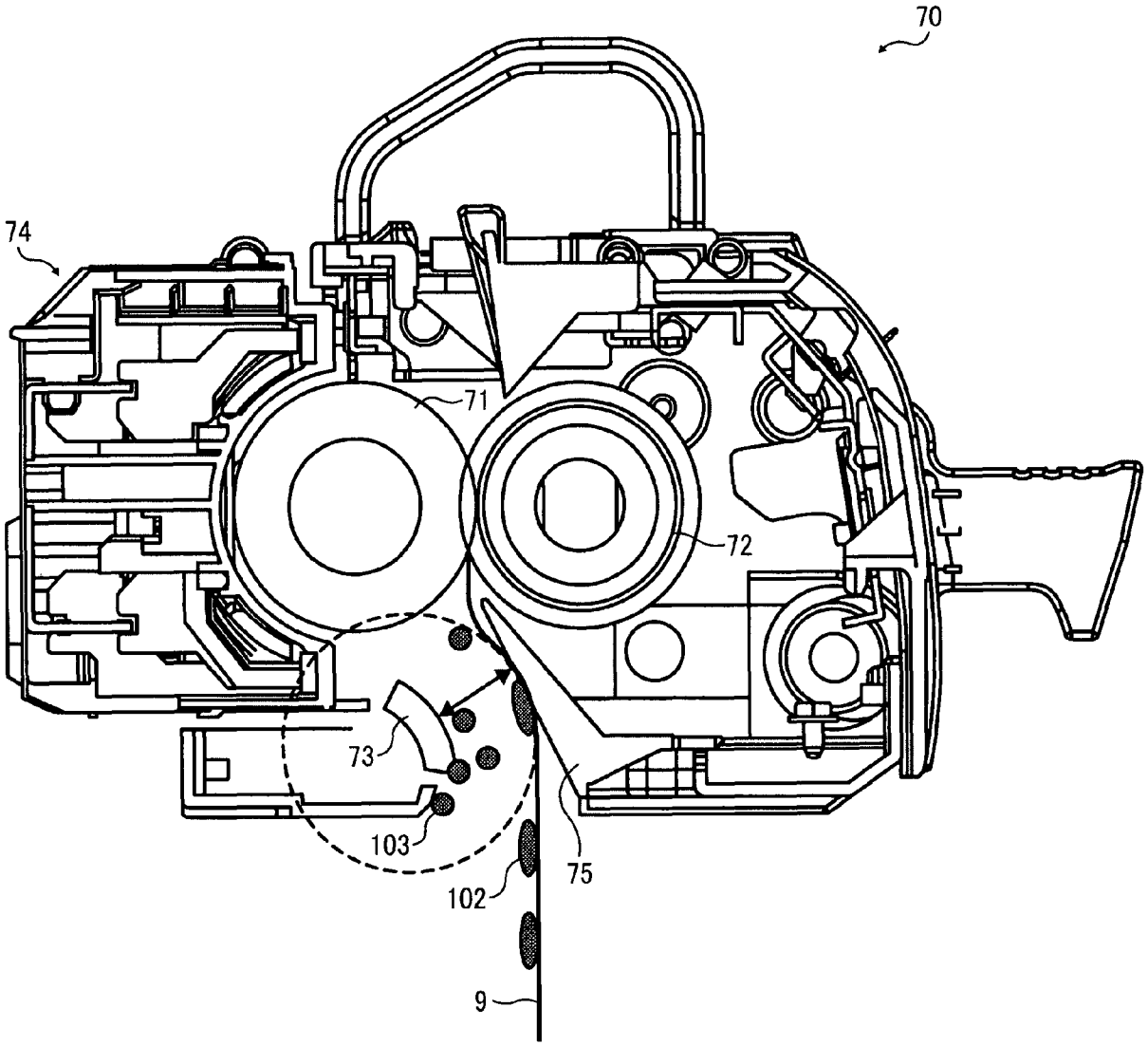
FIG. 3 is a schematic view illustrating an example of the fixing device of the present invention.

FIG. 3 is a schematic view illustrating an example of the fixing device of the present invention.

As illustrated in FIG. 3, the pressing roller 72 is contacted with heating roller 71. The induction heater 74 has configuration such that when the induction heater is cut along a plane parallel to the longitudinal direction of the induction heater, the wound wire of the coil pile 741 has a rectangular form while extending in the longitudinal direction of the induction heater. The both ends of the coil pile 741 are connected with an inverter so that an alternating current is applied thereto from a radio-frequency power source. By applying such an alternating current, magnetic fluxes are generated inside the coil pile 741 while changing the number of the magnetic fluxes, resulting in generation of an eddy current in the outermost layer of the heat roller 71, thereby heating the outermost layer and subjecting the heat roller 71 to induction heating.

In the fixing device 70 illustrated in FIG. 3, the recording sheet 9 bearing the unfixed toner 102 thereon is fed from the lower section of the device. The recording sheet 9 is guided by a guide plate 75 so as to be fed to a fixing nip formed by and between the heating roller 71 and the pressing roller 72. The unfixed toner image 102 on the recording sheet 9 is heated at the fixing nip upon application of pressure to fix the toner image onto the recording sheet.

As illustrated in FIG. 3, a first charger 73 serving as a first charging member is arranged at the entrance of the fixing device 70 in such a manner as not to be contacted with the heating roller 71. Hereinafter, the following description assumes that the toner has a negative charge. Alternatively, however, toner having a positive charge can also be used for the fixing device of the present invention.

Preferably, a material having good releasability, such as TEFLON (registered trademark), is used for the outermost layer of each of the heating roller 71 and pressing roller 72. In this regard, in order to prevent occurrence of electrostatic offset, in which negatively charged toner constituting a toner image on the recording sheet 9 is electrostatically transferred onto the heating roller 71, it is preferable to use a material having a higher negative chargeability than the toner for the outermost layer of the heating roller while using a positively chargeable material for the outermost layer of the pressing roller 72. However, since TEFLON (registered trademark) is a negatively chargeable material, it is preferable to use an electroconductive TEFLON (registered trademark) tube for the outermost layer of the pressing roller 72 while applying a voltage to the layer so as to have a potential of about 0V to prevent a toner image on the recording sheet from receiving a repulsive force from the pressing roller, resulting in prevention of occurrence of the electrostatic offset problem.

The first charger 73 may be formed of an electroconductive material so as to be able to be grounded. Alternatively, the first charger 73 may be formed of a positively chargeable material such as organic materials containing nitrogen (e.g., nylon and rayon), and oxides (e.g., glass) so as to be positively chargeable.

The first charger 73 of this fixing device illustrated in FIG. 3 has a curved, smooth surface so that the surface of the recording sheet 9 fed along the guide plate 75 has substantially the same distance (illustrated by a double-headed arrow) to the surface of the first charger, as illustrated by a broken-line circle. In addition, as illustrated in FIG. 3, the first charger 73 is arranged so as to face the surface of the recording sheet 9 bearing the unfixed toner image 102, and not the obverse surface. Therefore, the unfixed toner 102 on the recording sheet 9 is fed along the guide plate 75 while receiving substantially the same electrostatic force from the first charger 73 at all points so as to be firmly adhered to the recording sheet by the electrostatic force. When the electrostatic force posses localized variations, a problem in that the unfixed toner 102 moves along the portions receiving a different electrostatic force is often caused. Therefore, by using such a charger as having a curved surface similar to the curved surface of the recording sheet 9 on the guide plate 75, substantially the same electrostatic force can be applied to the unfixed toner 102 at all points, resulting in prevention of toner scattering.

Thus, the recording sheet 9 is fed to the fixing nip formed by and between the heating roller 71 and the pressing roller 72 while the unfixed toner image 102 thereon is electrostatically born on the recording sheet. However, in this state the unfixed toner 102 may still scatter in the air depending on variables such as behavior of the recording sheet 9 at the entrance, and angle and strength of contact of the sheet with the guide plate 75. Even in this case, scattered toner 103 is collected by the first charger 73 due to a potential difference between the toner and the first charger. Therefore, this technique is different from a technique in which an unfixed toner layer formed on a photoreceptor is intentionally scattered to form a toner image thereon while collecting the scattered toner. Specifically, the scattered toner 103 floating at the entrance of the fixing device is collected, thereby preventing adherence and fixation of scattered toner to parts of the fixing device and neighboring devices due to the fixing heat, resulting in accelerated deterioration of the parts. Moreover, where the scattered toner is adhered to the image forming members such as the heating roller and pressing roller, it results in formation of abnormal images. In addition, occurrence of a problem in that the scattered toner is fixedly adhered to the walls of the sheet feeding passage 88, and the fed recording sheet 9 is stopped by the fixed toner, resulting in jamming of the sheet, can also be prevented. Further, the first charger 73 also removes other foreign materials such as paper dust, thereby preventing fixation of such foreign materials on the heating roller 71 and the pressing roller 72.

Figure 4:
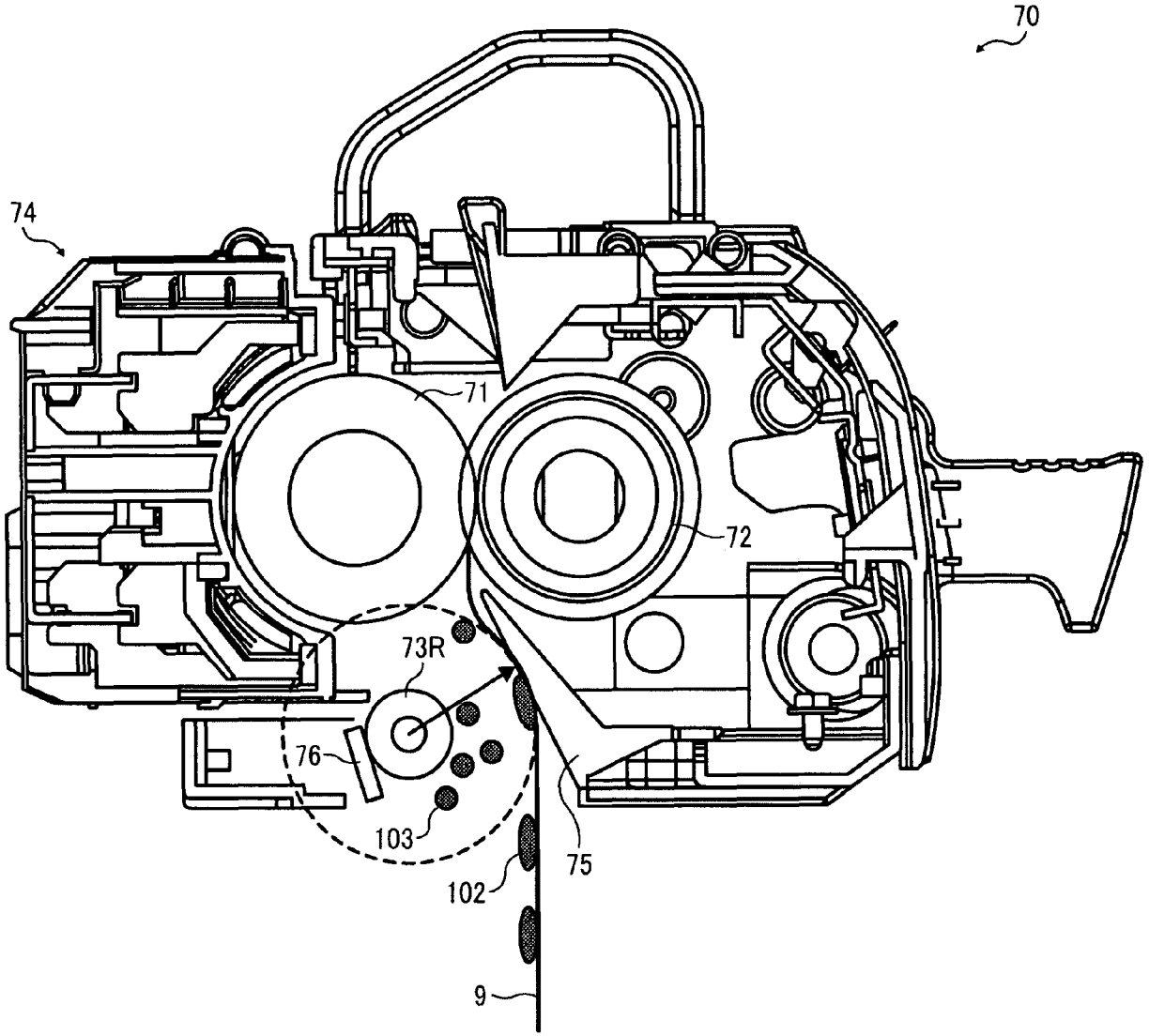
FIG. 4 is a schematic view illustrating another example of the fixing device of the present invention.

FIG. 4 is a schematic view illustrating another example of the fixing device of the present invention.

Referring to FIG. 4, it can be seen that a first charger 73R serving as a first charging member has a roller form, and includes a metal shaft made of a metal such as SUS and SUM, and an electroconductive layer formed on the circumferential surface of the metal shaft. The first charger 73R is rotatably supported by nonconductive bearings. The electroconductive layer is made of a positively chargeable material (such as nylon and rayon), to which an electroconductive material such as carbon black and metal powders (e.g., aluminum powders) is added, and has a fabric surface having a large surface area so that a large amount of foreign materials (such as toner particles and paper dust) can be adhered thereto.

Similarly to the first charger 73 illustrated in FIG. 3, the first charger 73R, which is a roller, also has a smooth surface so that the surface of the sheet 9 fed along the guide plate 75 has substantially the same distance to the surface of the first charger 73R as illustrated by a dotted circle in FIG. 4. Therefore, the unfixed toner 102 on the recording sheet 9 is fed along the guide plate 75 while receiving substantially the same electrostatic force from the first charger 73R.

The fixing device 70 illustrated in FIG. 4 further has a second charger 76, which serves as a second charging member and is fixedly provided so as to be contacted with the first charger 73R. The second charger 76 is made of a negatively chargeable organic material such as fluorine-containing resins (e.g., TEFLON (registered trademark)), acrylic resins, and polyester resins. Since the first charger 73R is rubbed by the second charger 76, the first charger is frictionally charged so as to have a charge with a polarity opposite to that of the unfixed toner 102 and scattered toner 103, thereby attracting the toner.

It is preferable that the first charger 73R is arranged in the vicinity of the heating roller 71 and the fed recording sheet 9, and the second charger 76 is arranged at a location far from the fed recording sheet. Specifically, as illustrated in FIG. 4, the second charger 76, first charger 73R and recording sheet 9 are lined horizontally in this order. More specifically, since the negatively charged second charger 76, positively charged first charger 73R, and recording sheet bearing the negatively charged unfixed toner 102 are arranged so as to be aligned in this order, the scattered toner 103 is attracted by the first charger 73R.

The first charger 73R is rotated by a driving source such as motors and transmitters provided below the heat roller 71. The first charger 73R is contacted with the second charger 76 to be frictionally charged. For example, when a driving source driving the fixing device 70 is used for driving the first charger 73R, the first charger 73R may be frictionally charged by the second charger 76 during an image forming operation to collect the scattered toner 103. When another motor drives the first charger 73R, the first charger 73R may be frictionally charged by the second charger 76 in a waiting time (i.e., in a time when an image forming operation is not performed) to collect the scattered toner 103.

Since it is assumed that the toner has a negative charge as mentioned above, the scattered toner 103 in the vicinity of the entrance of the fixing device 70 typically has a negative charge. Therefore, the scattered toner 103 is easily adhered to parts of the fixing device and neighboring devices due to the potential difference therebetween. In this regard, as the potential difference increases, the negatively charged toner is more easily adhered to the parts.

As mentioned above, the surface of the heating roller 71 is made of a negatively chargeable TEFLON (registered trademark) tube, and therefore the heating roller repels the scattered toner 103 having a negative charge. By contrast, the surface of the pressing roller 72 has a positive potential or zero potential (i.e., grounded) to avoid the above-mentioned electrostatic offset, and therefore the scattered toner 103 tends to be easily adhered thereto. When the scattered toner 103 accumulates on the pressing roller 72, the toner is fixedly adhered thereto, resulting in formation of a toner block. The toner block causes insufficient contact of the heating roller 71 with the pressing roller 72 at the fixing nip, resulting in insufficient application of heat and pressure thereto. Alternatively, an abnormal copy having the toner block on the backside thereof, which is transferred from the pressure roller, may be produced.

Figure 5:
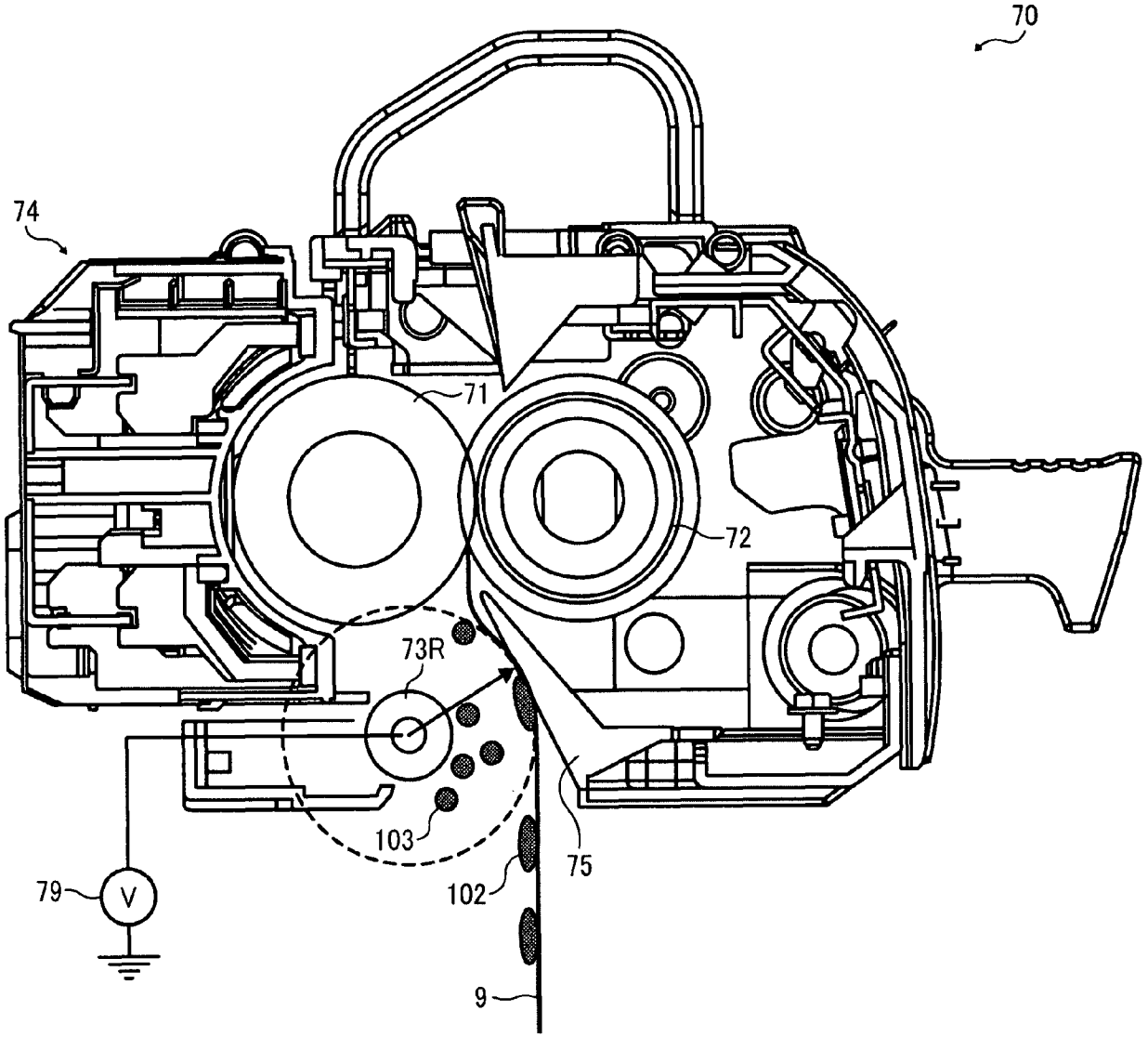
FIG. 5 is a schematic view illustrating another example of the fixing device of the present invention.

FIG. 5 is a schematic view illustrating another example of the fixing device of the present invention.

In the fixing device illustrated in FIG. 5, an alternating-current bias consisting of a combination of a DC voltage and an AC voltage or a direct-current bias of only a DC voltage is applied to the metal shaft of the first charger 73R so that the first charger has a predetermined potential. Specifically, since a bias is applied to the first charger 73R by a voltage supply 79 and the first charger has an electroconductive fabric layer on the surface of the metal shaft, the surface potential of the first charger increases. In addition, since the first charger 73R has a cylindrical form, the surface of the recording sheet 9 fed along the guide plate 75 has substantially the same distance to the surface of the first charger 73R as illustrated by a broken-line circle in FIG. 5. Therefore, the unfixed toner 102 on the recording sheet 9 is fed along the guide plate 75 while receiving substantially the same force from the first charger 73R.

The first charger 73R can be rotated by the driving source used for driving the fixing device 70 or an additional driving source such as motors.

The bias applied to the first charger 73R by the voltage supply 79 is preferably a positive voltage of from +100V to +1 kV to collect the scattered toner 103. In this regard, when the potentials of the first charger 73, toner, heating roller 71, and pressing roller 72 are A, B, C and D, respectively, the below-mentioned relations (1) and (2) are preferably satisfied.

Specifically, among the potentials of the first charger 73R, toner and heating roller 71, the following relation (1) is preferably satisfied:

$$|B-A|>|C-B| \quad (1).$$

Namely, the potential difference (i.e., |B−A|) between the toner and the first charger 73R is preferably greater than the potential difference (|C−B|) between the heating roller 71 and the toner. When relation (1) is satisfied, the scattered toner 103 is adhered to the first charger 73R more easily than the heating roller, thereby preventing toner scattering, resulting in prevention of formation of such abnormal images as mentioned above.

In addition, among the potentials of the first charger 73R, toner and pressing roller 72, the following relation (2) is preferably satisfied:

$$|B-A|>|D-B| \quad (2).$$

Namely, the potential difference (i.e., |B−A|) between the toner and the first charger 73 is preferably greater than the potential difference (|D−B|) between the pressing roller 72 and the toner. When relation (2) is satisfied, adhesion of the unfixed toner 102 to the pressing roller 72 can be prevented. In addition, since the potential difference between the toner and the first charger 73R is greater than that between the pressure roller 72 and the toner, the scattered toner 103 is attracted by the first charger 73R, thereby preventing scattering of the toner, resulting in prevention of formation of such abnormal images as mentioned above.

In addition, when the potentials of the first charger 73R, toner and recording sheet 9 are A, B and E, respectively, the following relations (3) is preferably satisfied:

$$|B-A|<|E-B| \quad (3).$$

Namely, the potential difference (|B−A|) between the toner and the first charger 73R is preferably greater than the potential difference (|E−B|) between the recording sheet 9 and the toner. When relation (3) is satisfied, the unfixed toner 102 on the recording sheet 9 is not electrostatically attracted to the first charger 73, resulting in prevention of scattering of the unfixed toner.

Figure 6:
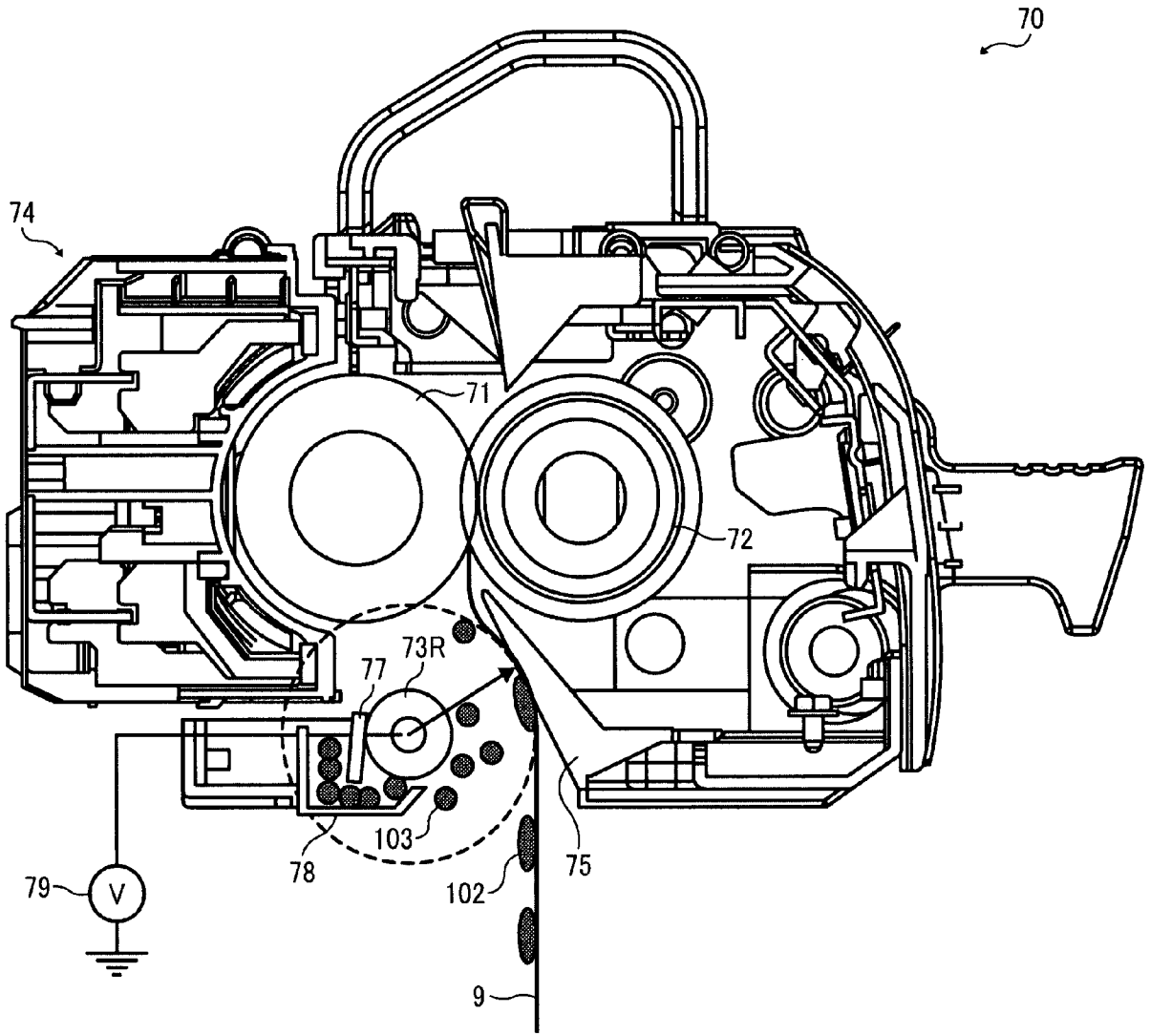
FIG. 6 is a schematic view illustrating another example of the fixing device of the present invention.

FIG. 6 is a schematic view illustrating another example of the fixing device of the present invention.

Referring to FIG. 6, the first charger 73R has a roller form, and includes a metal shaft made of a metal, and an electroconductive layer formed on the circumferential surface of the metal shaft. The first charger 73R is rotatably supported by nonconductive bearings. The electroconductive layer is made of a positively chargeable material (such as nylon or rayon) to which an electroconductive material such as carbon black or metal powders (such as aluminum powder) is added, and has a fabric surface having a large surface area so that a large amount of foreign materials (such as toner particles and paper dust) can be adhered thereto.

Similarly to the first charger 73R illustrated in FIG. 4, the first charger 73R illustrated in FIG. 6 is a roller, and has a smooth surface so that the surface of the recording sheet 9 fed along the guide plate 75 has substantially the same distance to the surface of the first charger 73R as illustrated by a dotted circle in FIG. 6. Therefore, the unfixed toner 102 on the recording sheet 9 is fed along the guide plate 75 while receiving substantially the same electrostatic force from the first charger 73R at all points.

The fixing device includes a blade 77 contacted with the circumferential surface of the first charger 73R. The toner collected by the first charger 73R tends to accumulate on the fabric surface of the first charger, and the accumulated toner is aggregated by the heat of the heating roller 71, resulting in formation of toner blocks on the surface of the first charger. Such toner blocks do not affect image quality, but do lessen the toner collection effect of the first charger 73R because the first charger cannot have the desired potential even when, the same bias is applied thereto. In order to prevent deterioration of the toner collection effect, the toner accumulating on the surface of the first charger 73R is scraped off by the blade 77, which is not electroconductive. The toner scraped off the first charger 73R is collected and contained in a chamber 78. Therefore, toner blocks are hardly formed on the surface of the first charger 73R, thereby hardly degrading the toner collection effect of the first charger 73R.

The image forming apparatus of the present invention includes the above-mentioned fixing device 70 as illustrated in FIG. 1. Therefore, the image forming apparatus can reliably produce high quality images over a long period of time without causing the toner scattering problem and without forming abnormal images.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-211522 and 2010-101562, filed on Sep. 14, 2009, and Apr. 27, 2010, respectively, the entire contents of which are herein incorporated by reference.

What is claimed is:

1. A fixing device comprising:

a heating source;

a heating member heated by the heating source;

a pressing member contacting the heating member to form a fixing nip therebetween, at which an unfixed image of toner on a recording sheet is fixed to the recording sheet;

a first charging member located at an entrance of the fixing device, from which the recording sheet bearing the unfixed toner image enters the fixing device, the first charging member facing the unfixed toner image on the recording sheet while not contacting the heating member and the pressing member, and having a charge with a polarity opposite to a polarity of a charge of the toner to collect particles of the toner floating at the entrance of the fixing device.

2. The fixing device according to claim 1, further comprising:

a second charging member contacted with the first charging member while rubbing the first charging member to impart a frictional charge, wherein the first charging member rotates.

3. The fixing device according to claim 1, further comprising:

a bias applying member configured to apply a bias to the first charging member.

4. The fixing device according to claim 1, wherein at least one of the following relations (1) and (2) is satisfied:

$$|B-A|>|C-B| \quad (1), \text{ and}$$

$$|B-A|>|D-B| \quad (2),$$

wherein A, B, C and D respectively represent potentials of the first charging member, the toner, the heating member, and the pressing member.

5. The fixing device according to claim 1, further comprising:

a cleaner configured to remove the collected toner particles from the first charging member.

6. An image forming apparatus comprising:

an image forming device configured to form an unfixed toner image on a recording sheet; and the fixing device according to claim 1, configured to fix the toner image onto the recording sheet.

* * * * *